US009908672B2

(12) United States Patent
Massinello

(10) Patent No.: US 9,908,672 B2
(45) Date of Patent: Mar. 6, 2018

(54) CONTAINER WITH REMOVABLE LID AND REMOVABLE APPLICATOR

(71) Applicant: Nina Massinello, Royal Palm Beach, FL (US)

(72) Inventor: Nina Massinello, Royal Palm Beach, FL (US)

( * ) Notice: Subject to any disclaimer, the term of this patent is extended or adjusted under 35 U.S.C. 154(b) by 0 days.

(21) Appl. No.: 15/617,894

(22) Filed: Jun. 8, 2017

(65) Prior Publication Data

US 2017/0275067 A1 Sep. 28, 2017

Related U.S. Application Data

(63) Continuation of application No. PCT/US2017/018271, filed on Feb. 17, 2017.

(60) Provisional application No. 62/296,402, filed on Feb. 17, 2016.

(51) Int. Cl.

| | |
|---|---|
| ***A45D 34/00*** | (2006.01) |
| ***B65D 51/32*** | (2006.01) |
| ***B65D 1/10*** | (2006.01) |
| ***B65D 41/04*** | (2006.01) |
| ***A45D 34/04*** | (2006.01) |

(52) U.S. Cl.

CPC ..... *B65D 51/32* (2013.01); *A45D 34/046* (2013.01); *B65D 1/10* (2013.01); *B65D 41/045* (2013.01)

(58) Field of Classification Search

CPC ... A45D 34/045; A45D 34/046; A45D 34/047
USPC ..... 401/121, 122, 123, 124, 125, 126, 127, 401/128, 129, 130; 215/276
See application file for complete search history.

(56) References Cited

U.S. PATENT DOCUMENTS

| | | | | |
|---|---|---|---|---|
| 1,152,107 A * | 8/1915 | Kerr | B65D 51/145 215/276 |
| 2,135,239 A | 11/1938 | Patterson | |
| 2,593,591 A | 4/1952 | Menkin et al. | |

(Continued)

FOREIGN PATENT DOCUMENTS

| | | |
|---|---|---|
| DE | 3240151 | 5/1984 |
| EP | 0 764 410 | 3/1997 |

OTHER PUBLICATIONS

Search Report dated May 8, 2017 which issued in the corresponding International Patent Application No. PCT/US2017/018271.

(Continued)

*Primary Examiner* — Jennifer C Chiang
*Assistant Examiner* — Joshua Wiljanen
(74) *Attorney, Agent, or Firm* — Cozen O'Connor

(57) ABSTRACT

A container comprising a jar defining a volume for containing a liquid, the jar having a rim defining an opening having a first diameter, a removable lid defining a through hole of a second diameter and having a coupling element, the removable lid sealing the opening of the jar; a tool configured to extend through the removable lid and having a working portion disposed in the volume when the tool is attached the jar opening, wherein each of the working portion has a diameter less than the second diameter, which is smaller than the first, such that for an amount of liquid material above a threshold, the tool can access the liquid material through the throughhole, and for an amount of liquid material at or below the threshold, the lid is removable and the tool is used to access the liquid material.

10 Claims, 11 Drawing Sheets

(56) References Cited

U.S. PATENT DOCUMENTS

| | | | | |
|---|---|---|---|---|
| 2,793,012 | A | 5/1957 | Wolf | |
| 3,092,281 | A | 6/1963 | Davidson | |
| 3,870,186 | A | 3/1975 | Reinhard | |
| 4,194,848 | A | 3/1980 | Kingsford | |
| 4,841,996 | A | 6/1989 | Gueret | |
| 6,588,614 | B2 | 7/2003 | Neuner | |
| 7,066,675 | B1 * | 6/2006 | Miller | A45D 29/007 401/126 |
| 7,118,298 | B2 | 10/2006 | Tsutsumi | |
| 7,225,814 | B2 | 6/2007 | Barclay | |
| 8,313,263 | B2 | 11/2012 | Gueret | |
| 8,702,332 | B2 | 4/2014 | Hartstock et al. | |
| 2005/0161460 | A1 | 7/2005 | Depasquale et al. | |
| 2013/0129402 | A1 | 5/2013 | Johnson et al. | |

OTHER PUBLICATIONS

Directions for Home Water Bath Canning. PickYourOwn.org. Mar. 19, 2012. [Apr. 9, 2017]. Retrieved from internet: url: https://web.archive.org/web/20120319163525/http://www/pickyourown.org//water_bath_canning_directions.php>.

* cited by examiner

CONTAINER WITH REMOVABLE LID AND REMOVABLE APPLICATOR

CROSS REFERENCE TO RELATED APPLICATIONS

This application is a continuation of application No. PCT/US2017/018271, filed on Feb. 17, 2017. Priority is claimed on U.S., Provisional Application No. 62/296,402, filed Feb. 17, 2016, the content of which is incorporated here by reference.

BACKGROUND OF THE INVENTION

1. Field of the Invention

The present invention relates to a container having a removable lid with a removable applicator, and more particularly to a container for a product that is configured such that substantially all of the product in the container is accessible by an applicator removably attached to a lid for the container.

2. Description of the Related Art

Nail polish is an example of a product that is typically sold to consumers in containers that have screw tops that include an integrally formed applicator brush. The container is a bottle that stores the nail polish, with the bottle having a narrow bottleneck provided with an external thread. The screw top, which is screwed onto the screw part of the bottleneck, seals the bottle. An applicator having a rod with a brush at its free end is attached to the screw top.

The nail polish container having the above configuration is used in such a manner that a user opens a bottle, in which the nail polish is stored, by rotating the screw top. Excess nail polish is removed from the brush along an edge of the bottle opening. The polish is than applied in an ordinary manner.

Due to the configuration of the opening through the narrow bottleneck, the brush cannot contact all of the content contained in the bottle, particularly as the content level is depleted below a threshold level. The brush can only access the center of the bottle beneath the bottleneck. Thus, after the content falls below a certain level, it becomes difficult to access the remaining content with the applicator. As a result, the remaining content is typically discarded, resulting in waste of product and cost to consumer.

SUMMARY OF THE INVENTION

It is an object of the present invention to provide a solution to the problem discussed above, and overcome the shortcomings of prior devices and methods, by providing a container configured as a jar with an airtight removable lid feature that addresses the problem of being unable to utilize a non-insignificant portion of the contents in the container, for example a nail polish container.

In accordance with an aspect of the present invention, a jar (typically a bottle) containing a volume of liquid is provided, with the jar having a removable top to which a brush assembly is removably attached. After a quantity of the content is used, and the remainder is too difficult to access, the lid can be removed, thereby providing means for the brush to access the remainder of the liquid content.

One aspect of the invention is a jar design housing liquid content, and which allows significantly less content to be wasted in the bottle. The design provides a container that includes a jar, a lid configured to seal the jar, and an applicator brush that is removably attached to the lid. In other words, when the lid is removed from the jar and the applicator brush is removed from the lid, the applicator brush can access a majority of the remaining content in the jar so that the remaining content is not wasted.

Additionally, because the container uses a jar with a wide mouth, it can be easily refilled, compared to known nail polish bottles and/or thoroughly cleaned to be recycled, further reducing its waste because its materials, in the case of a glass container, can be recycled many times.

In one embodiment, a container is disclosed having a jar defining a volume for containing a liquid material therein. The jar has a rim which defines an opening to the jar having a first diameter. A removable lid defining a throughhole of a second diameter is provided. The removable lid has a coupling element and the removable lid is configured to seal the opening of the jar. A tool is configured to extend through the removable lid and removably attach thereto, the tool having a handle, a wand, and a working portion, the working portion being disposed in the volume when the tool is attached to the jar opening, wherein each of the wand, and the working portion, have diameters less than the second diameter, wherein the second diameter is smaller than the first diameter, such that for an amount liquid material above a threshold amount, the tool can be used to access the liquid material through the throughhole, and for an amount of liquid material at or below the threshold amount, the lid is removed and the tool is used to access the liquid material without the throughhole.

In one embodiment, the container includes a brush cap that is threadingly connected to a lid and the lid is removably attached to the jar. Wipe technology may be provided, for example at or in the opening of the jar, to remove excess material from the brush, or by simply drawing the brush across the mouth of the container to remove excess content.

In one embodiment, the jar is provided with holding elements to hold the brush assembly when the lid is removed from the jar. The holding elements can be further configured as wiping elements to remove excess material from the brush.

According to one aspect of the invention, the package, i.e., container, comprises a bottle (or jar) having a rim defining an opening to the bottle having a first diameter. A removable lid having a coupling element is configured to seal the opening of the bottle. A tool, typically a brush assembly, is provided that is removably attached to the coupling element of the removable lid. The tool has a handle, a shaft (or wand), and a working portion (typically an applicator tip, such as bristles, sponge, or the like), wherein each of the handle, the shaft, and the working portion are smaller than a second diameter in a radial direction, the second diameter being smaller than the first diameter.

According to one aspect of the invention, a ledge is arranged at a rim of the bottle. The ledge is configured to hold the tool when the lid is removed from the bottle. The ledge has a slot configured to accept the shaft of the tool (brush assembly).

According to one aspect of the invention, the slot comprises a wiping element configured to wipe at least part of the tool (e.g., bristles).

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

A container is disclosed, having a removable lid that allows users to access residual contents of the container. For example, when used to dispense nail polish, the disclosed container enables users to obtain access to, via the brush, substantially all of the nail polish from the container. The disclosed container allows users to extend the life of the nail polish container therein by being able to dip the brush to an area wider than that allowed by existing nail polish bottles. This allows users to access substantially the entire contents of the container. Additionally solvents can be easily added to the container due to the wide mouth of the jar portion of the container. The features of the disclosed container will eliminate waste and enhance users' ability to access and/or modify the contents. Specifically, the jar and removable lid prevent nail polish bottles from needing to be disposed of once they are partially used, allow the bottle to be refilled, and enable a user to create custom nail polish colors.

Figure 1:
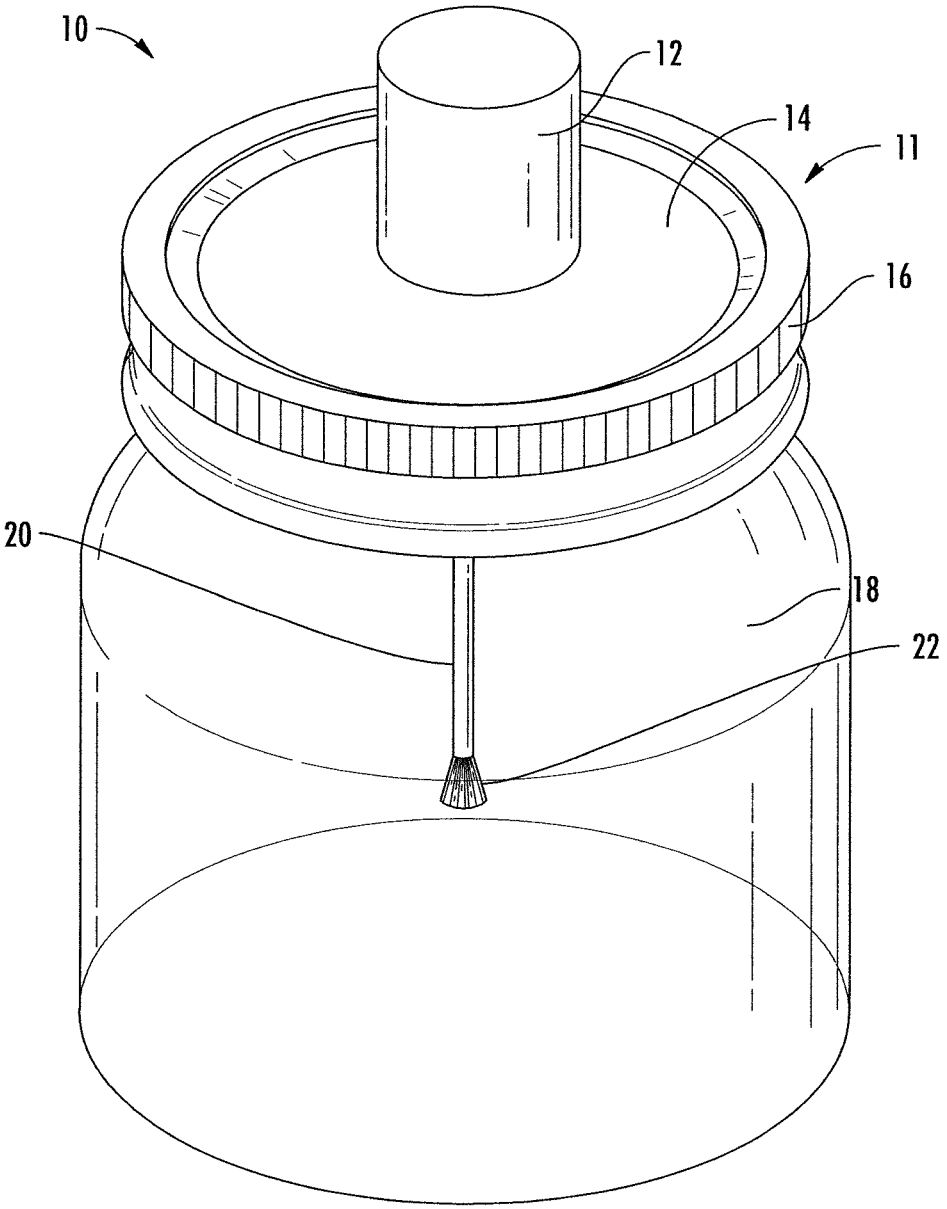
FIG. 1 is a perspective view of a container having a lid, jar and applicator.

FIG. 1 is a perspective view of a container 10 according to a first aspect of the invention. As shown, the container comprises a jar 18 sealed by a lid 11. According to a first aspect of the invention, the overall lid 11 comprises a cover portion 14 and a coupling element, preferably configured as a locking portion 16. The locking portion 16 and the cover portion 14 can be separate components or integrally formed as a single unit. An applicator assembly 30, such as a brush, is removably attached to the cover portion 14. The applicator assembly 30 includes a handle 12, a wand 20, and bristles 22.

Figure 2:
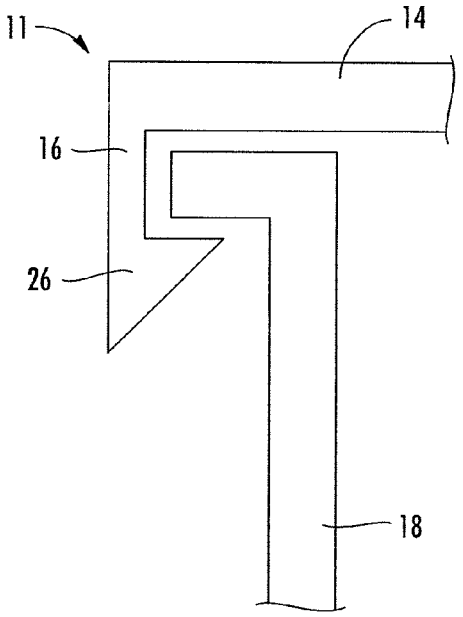
FIG. 2 is a partial view of the jar and lid of the container.

According to one embodiment, the locking portion 16 is threaded and the jar 18 has a corresponding thread. Alternatively, as shown in FIG. 2, the locking portion 16 and jar 18 can be coupled using a snap ring. The jar 18 has a lip and the locking portion 16 has a catch 26 that mates with the lip of the jar 18.

Figure 3:
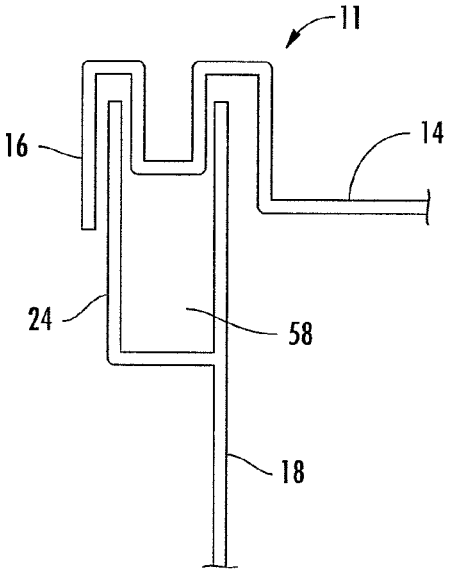
FIG. 3 is a partial view of the jar and lid of the container according to another embodiment.

According to another aspect of the invention shown in FIG. 3, the jar 18 has an integral wall 24 defining a moat or channel 58 around its top edge and the locking portion 16 and the cover portion 14 seals both with the rim of the jar 18 and an upper edge of the moat 58. The seal can be a plug-type seal in which a depressed portion in the cover portion 14 fits inside the mouth of the jar 18, a telescope-type seal by which a rim of a cover portion 14 fits inside or outside an upstanding rim of the jar 18, or a rim-seal where the rim of the jar 18 and/or the upper edge of the moat are held between integral upstanding walls on the rim. Combinations of different types of seals may be used.

Figure 4:
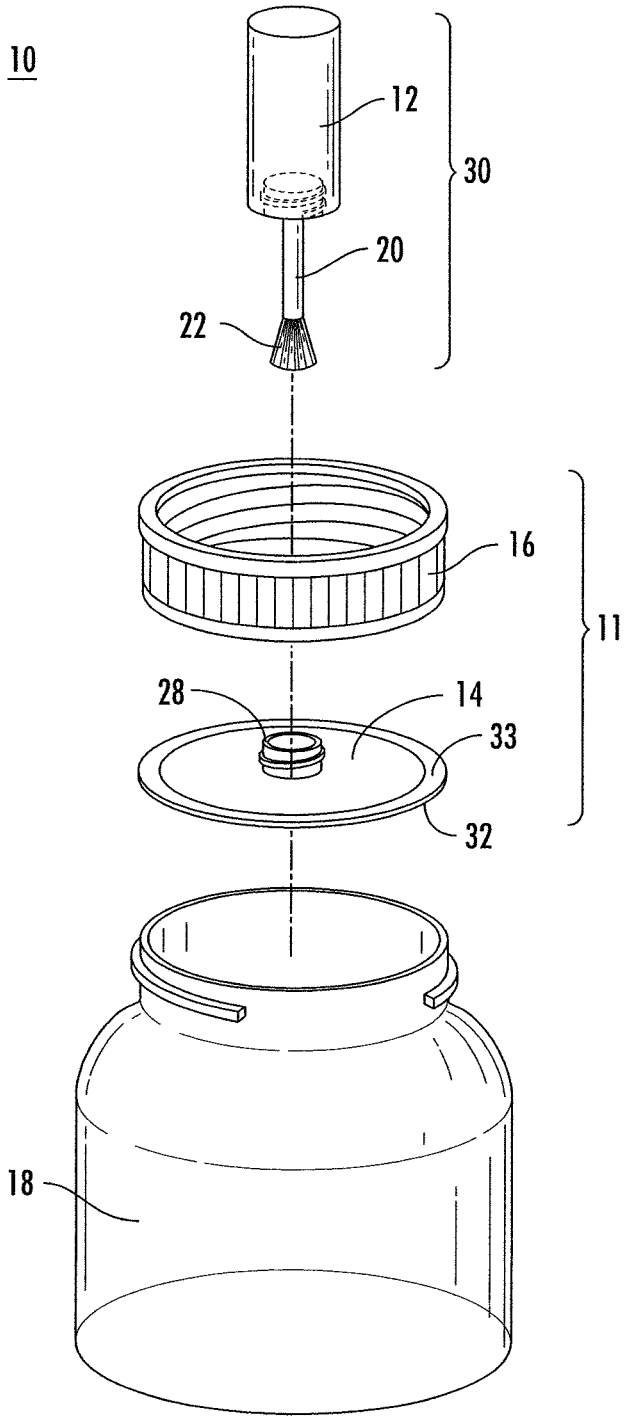
FIG. 4 is an exploded view of the container.

FIG. 4 is an exploded view of a container 10. As shown, the jar 18 is closed by cover portion 14. To aid in sealing, the cover portion 14 can have one or more gaskets 33. Gasket 33 is shown between the locking portion 16 and the cover portion 14. A peripheral lip 32 can be provided between the cover portion 14 and the mouth of jar 18 to assist in placement of the cover portion about the mouth. If the locking portion 16 and the cover portion 14 are integrally formed, a gasket 32 may still be provided between the cover portion 14 and the rim of jar 18. The gasket 32 may be separate from the cover portion 14 or may be integrally formed with the cover portion 14 by co-molding, or the like. Alternatively, additional gasket may be included above and/or below the cover portion 14.

Figure 7:
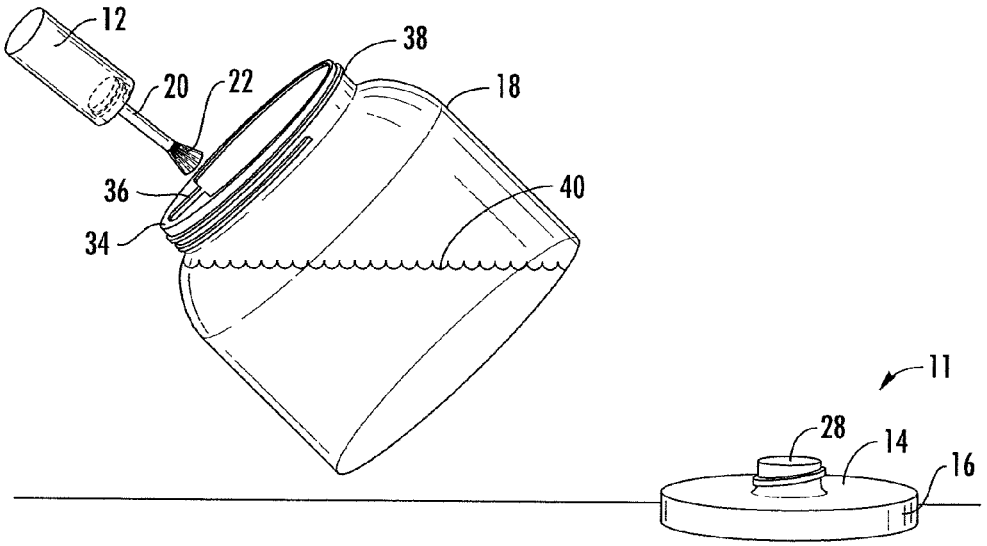
FIG. 7 is a perspective view of a jar and applicator assembly.

As shown in FIGS. 4 and 7, a land 28 is formed on cover portion 14 and includes a through hole extending through the cover portion. The land provides a support for the applicator assembly 30 and may include threading to provide releasable attachment of the assembly 30 to the cover portion 14.

The applicator/brush assembly 30 includes a handle 12, a wand 20, and bristles 22. The assembly 30 is removably attached to the cover portion 14 via land 28. Handle 12 and land 28 can be threaded or, alternatively, have interlocking snaps, provide a friction fit, or the like. According to one aspect of the invention, the land 28 has an internal taper narrowing towards the bottom of the jar 18 to remove excess material from the bristles 22. The land 28 or the handle 12 can include a sealing element in the form of a gasket. The gasket can be co-molded with the handle 12 or the coupling 28. Alternatively, the gasket can be a discrete gasket or O-ring.

Figure 5:
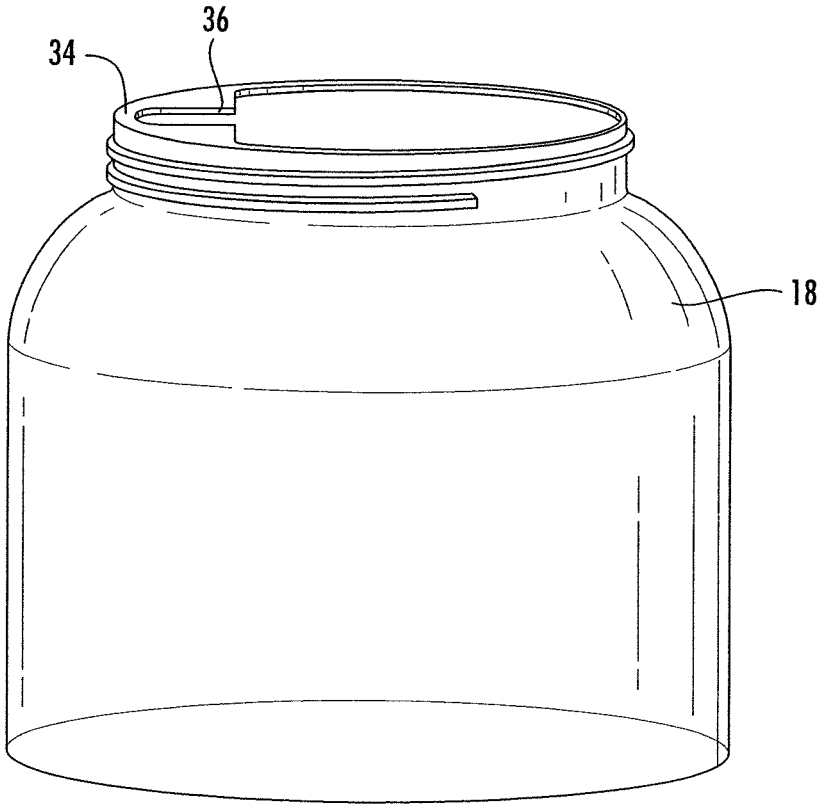
FIG. 5 is a perspective view of the jar.

FIG. 5 is a perspective view of a jar 18. As shown, in one embodiment, the jar 18 has a ledge 34 configured as a rest for the brush assembly 30. The ledge 34 has an indentation or slot 36 configured as a slot. In use, when the handle 12 of the brush assembly 30 is resting on the ledge 34, the wand 20 passes through the slot 36. In this way, the ledge 34 can support the brush assembly 30 without blocking the mouth of the jar 18.

Figure 6:
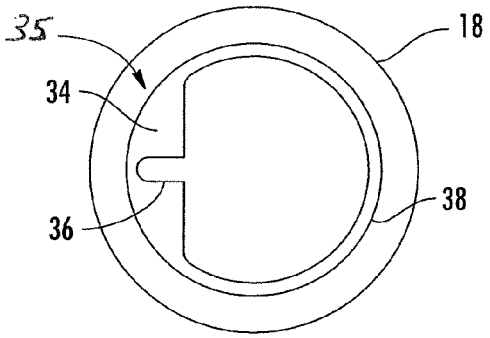
FIG. 6 is a top view of the jar of FIG. 5.

In one embodiment, the ledge 34 and slot 36 (as shown in FIGS. 5 and 6) are configured as a member 35 such as an insert piece which is removably or permanently secured to the mouth of the jar by a friction fit or an adhesive. The member may be formed of a plastic or other suitable material.

FIG. 6 is a top view of the jar of FIG. 5. As shown, the mouth of the jar 18 is defined by the rim 38, for receiving the member 35 having the ledge 34 and the slot 36. The mouth of the jar 18 is large enough so that the entire contents of the jar is accessible by the brush assembly 30. According to one aspect of the invention, the wand 20 and the slot 36 are dimensioned so that there is an interference fit therebetween. The interference fit between the wand 20 and the slot 36 holds the brush assembly 30 in the slot when the brush assembly is released by a user and, in particular, during access of the container contents through the mouth, as opposed to access through land 28, thereby preventing the brush assembly 30 from accidentally falling into the jar 18.

FIG. 7 is a perspective view of the jar 18 and brush assembly 30. In use, once the contents 40, in this case nail polish, of the jar 18 reaches a level at which dipping the bristles 22 in the contents 40 through the land 28 is difficult, the lid 11, which includes cover portion 14, is removed.

As shown in FIG. 7, the rim 38 of the jar 18 is threaded. To easily dip the bristles 22 in the nail polish 40, the jar 18 can be tilted. It should be noted that the ledge 34 serves to prevent spilling by acting as a dam. According to one aspect of the invention, the slot 36 is configured as a wiper to remove excess material from the bristles 22. Once the bristles 22 are dipped in the nail polish 40, excess material can be removed by passing the bristles 22 through the slot 36. While the slot configured as a wiper has advantages, it is not necessary for the invention.

It should be noted that the jar 18 can hold other materials such as paint, nail oil, copying corrective fluid, and the like. The brush assembly 30 can be replaced by other applicator tools such as a dropper, a spatula, a scoop, and the like as would be appropriate for the material in the jar 18.

The jar 18, the cover portion 14, and the locking portion 16 can be produced from a variety of materials including glass, metal, wood, and plastic. The cover portion 14, and the locking portion 16 can be molded plastic and formed as an integral unit or formed as two separate pieces.

Figure 8:
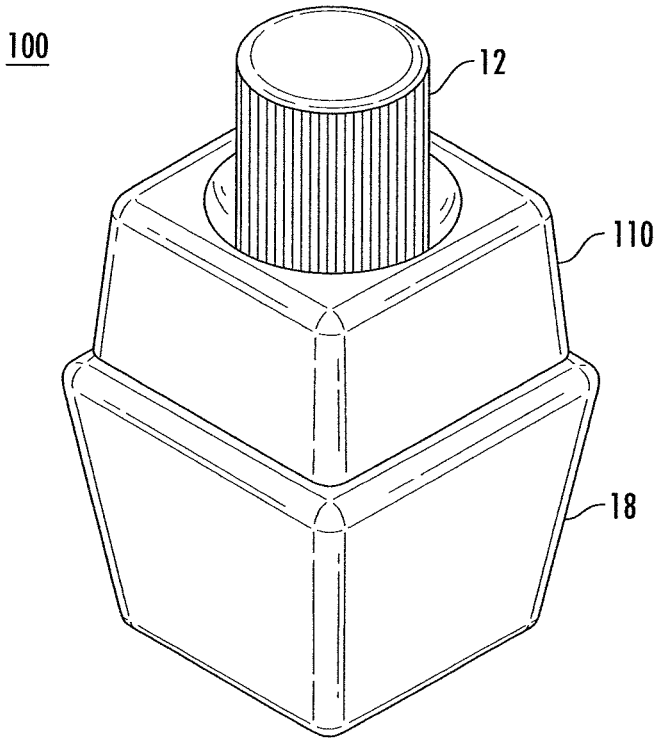
FIG. 8 is a perspective view of a container according to a second embodiment.

FIGS. 8-28 show an additional embodiment of the container of the present invention. FIG. 8 is a perspective view of the container 100 of this additional embodiment. In this view, in which the container 100 is in an assembled state, the handle 12 of the brush assembly 30 is visible protruding from the top of the lid 110, to which it is coupled, preferably through a threaded engagement. The lid 110 is coupled, for example by threading, to the jar 18. In this embodiment, as will be described further hereinafter, the lid 110 is integrally formed, for example, of plastic or similar material.

Figure 9:
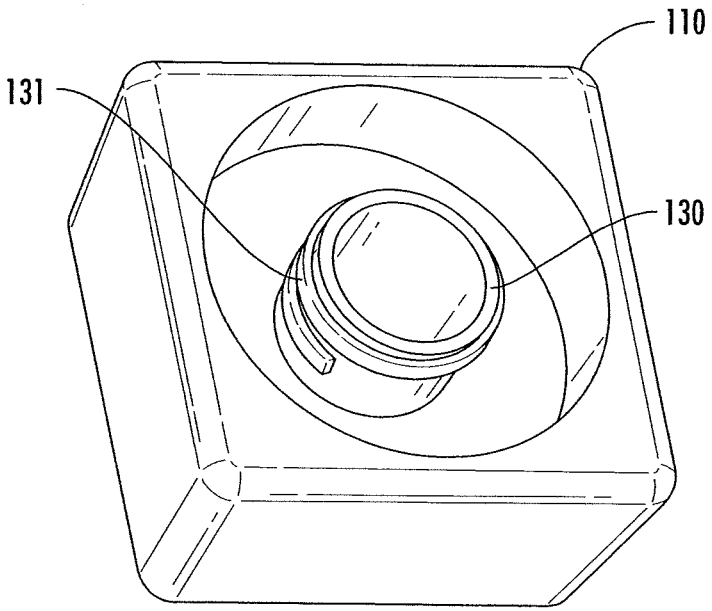
FIG. 9 is a perspective view from above of a lid of the container shown in FIG. 8.

FIG. 9 is a view of the lid 110. As shown in FIG. 9, the lid 110 includes a chambered aperture 130 having outer threading 131 that is configured to rotatably and removably engage with inner threading in the handle 12 of the brush assembly 30.

Figure 10:
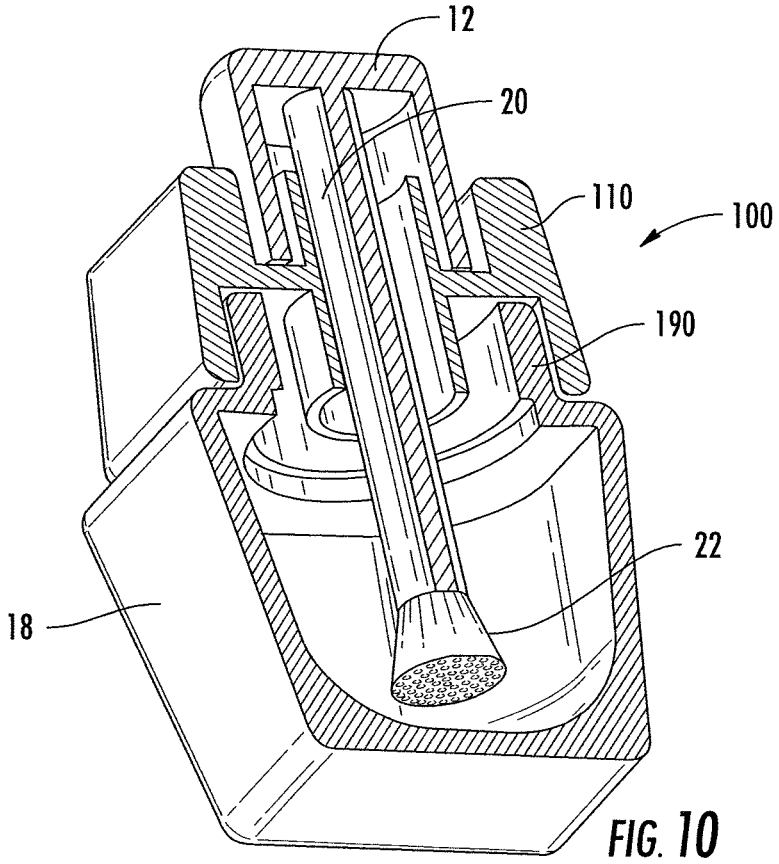
FIG. 10 is a cross sectional view of the container shown in FIG. 8.

FIG. 10 is a cross-section of the container 100 shown in FIG. 8. Visible in the cross-section are the handle 12, the wand 20, the bristles 22, the lid 110, a mating rim 190 of the jar 18, and the jar 18 itself.

Figure 11:
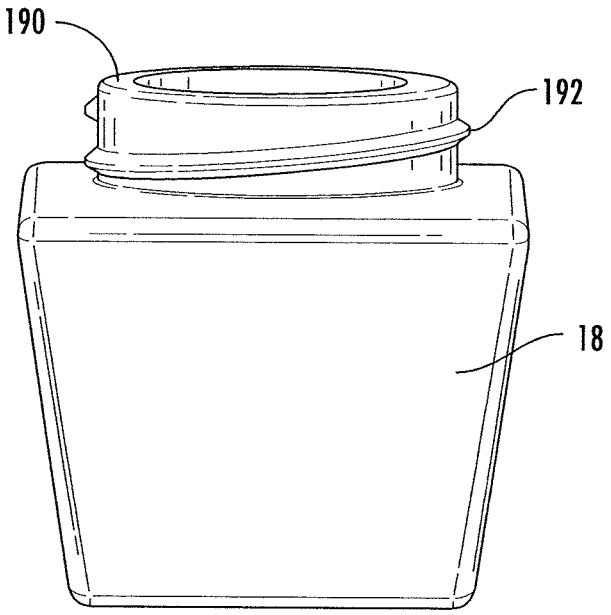
FIG. 11 is an elevational view of the jar of the container shown in FIG. 8.

FIG. 11 is a side perspective view of the jar 18 according to this embodiment. At its top, the jar has the mating rim 190 discussed above, with outer threading 192. The outer threading 192 is configured to mate with corresponding threading around in inner rim of the lid 110, which will be discussed in more detail below.

Figure 12:
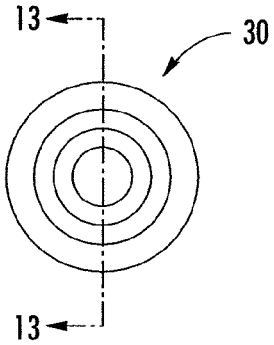
FIG. 12 is a schematic plan view of the applicator assembly of the container shown in FIG. 8.
Figure 13:
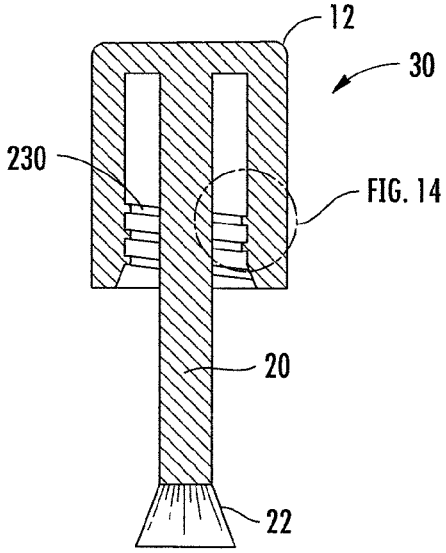
FIG. 13 is a section view of the applicator assembly taken along 13-13 from FIG. 12.

FIG. 12 is a schematic top view of the brush assembly 30. FIG. 13 is a section taken along 13-13 from FIG. 12. In addition to the handle 12, the wand 20 and the bristles 22, FIG. 13 also shows threading 230, which is configured to rotatably engage threads 131 of the lid 110, which will be discussed further below.

Figure 14:
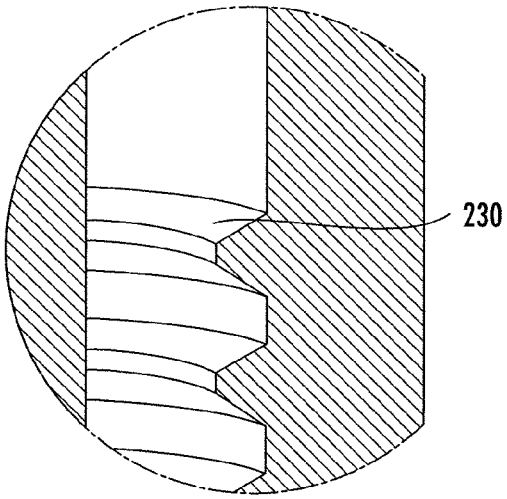
FIG. 14 is a detail of a portion of FIG. 13.

FIG. 14 is a close up detail view of the threads 230 from the corresponding circled portion of FIG. 13.

Figure 15:
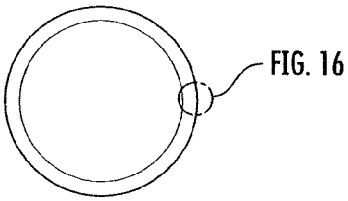
FIGS. 15 and 16 show close up views of the handle portion of the applicator.
Figure 16:
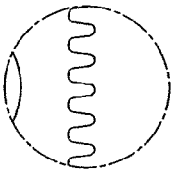
Figure 17:
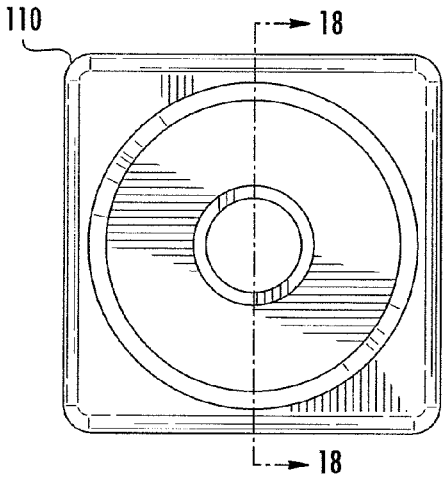
FIG. 17 is a plan view of the lid of the container shown in FIG. 8.

FIGS. 15 and 16 show the exterior of the handle for the brush assembly, which includes surface knurlings to provide an improved grip to hold the handle and release/secure the brush assembly from the cover.

Figure 18:
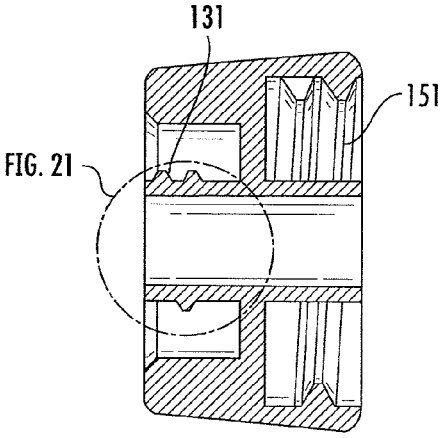
FIG. 18 is a sectional view of the lid taken along 18-18 from FIG. 17.
Figure 19:
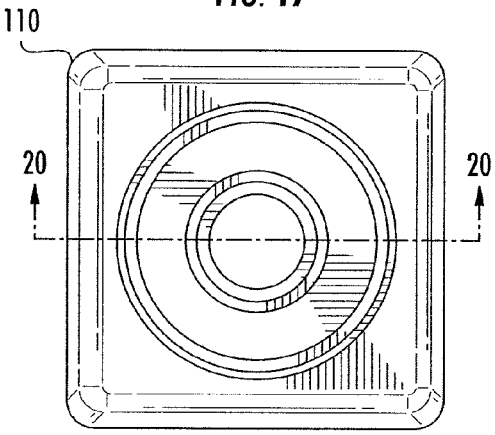
FIG. 19 is a sectional view of the lid shown in FIG. 17.
Figure 20:
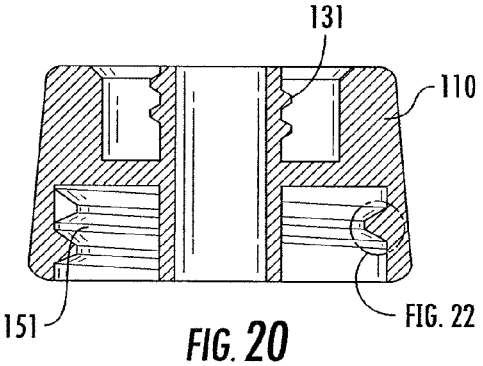
FIG. 20 is a section view of the lid taken along 20-20 from FIG. 19.
Figure 21:
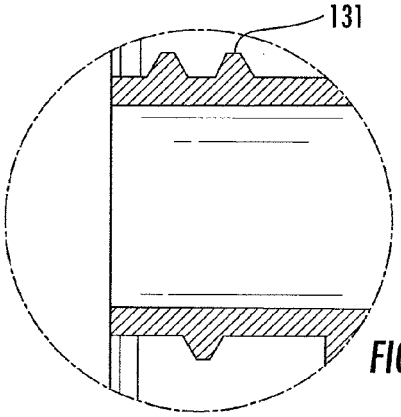
FIG. 21 is a detail of a portion of FIG. 18.
Figure 22:
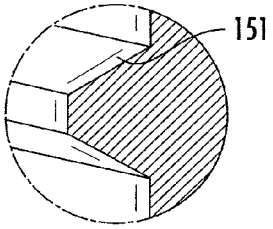
FIG. 22 is a detail of a portion of FIG. 20.

FIGS. 17-22 are various views of the lid 110 according to this embodiment. For example, FIG. 18 is a section taken along 18-18 from FIG. 17. As can be seen in FIGS. 18-22, the lid 110 includes threading 131 configured to engage threading 230 of the handle of the brush assembly 30. Also as shown in FIGS. 18-22, the lid 110 also includes threading 151, configured to engage threads 192 of the jar 18.

Figure 23:
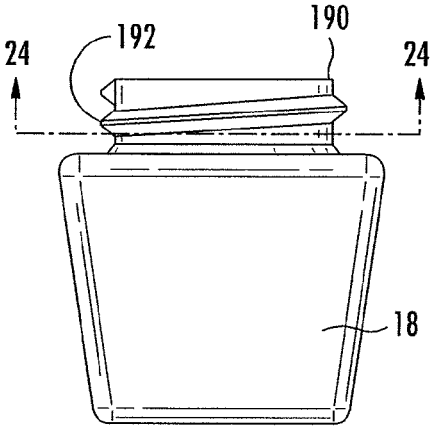
FIG. 23 is an elevational view of the jar of the container shown in FIG. 8.
Figure 24:
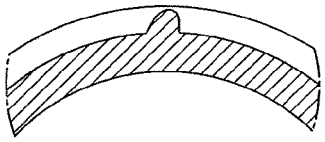
FIG. 24 is a section view of the jar taken along 24-24 from FIG. 23.
Figure 25:
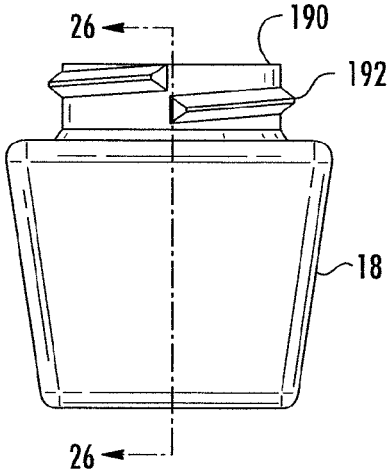
FIG. 25 is another elevation view, rotated from the view of FIG. 23.
Figure 26:
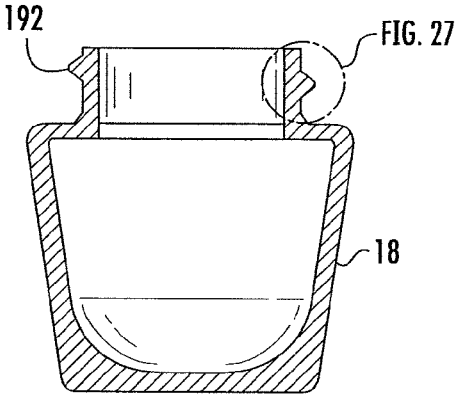
FIG. 26 is a section view of the jar taken along 26-26 from FIG. 25.
Figure 27:
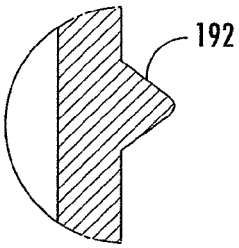
FIG. 27 is a detail of a portion of FIG. 26.
Figure 28:
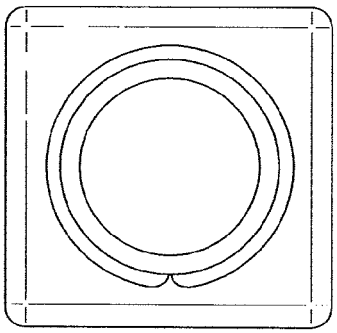
FIG. 28 is a plan view of the jar of FIG. 23 and FIG. 25.

FIGS. 23-28 are various views of the jar 18 according to this embodiment. For example, FIG. 23 is a side elevation view of the jar 18 and shows the threading 192 formed on the mating rim 190. FIG. 24 is a section taken along 24-24 from FIG. 23. FIG. 25 is a side elevation view of the jar 18 rotated as compared with the view of FIG. 23. FIG. 26 is a section taken along 26-26 from FIG. 25. FIG. 27 is a detail view of the threading 192 and FIG. 28 is a plan view of the jar 18.

Figure 29:
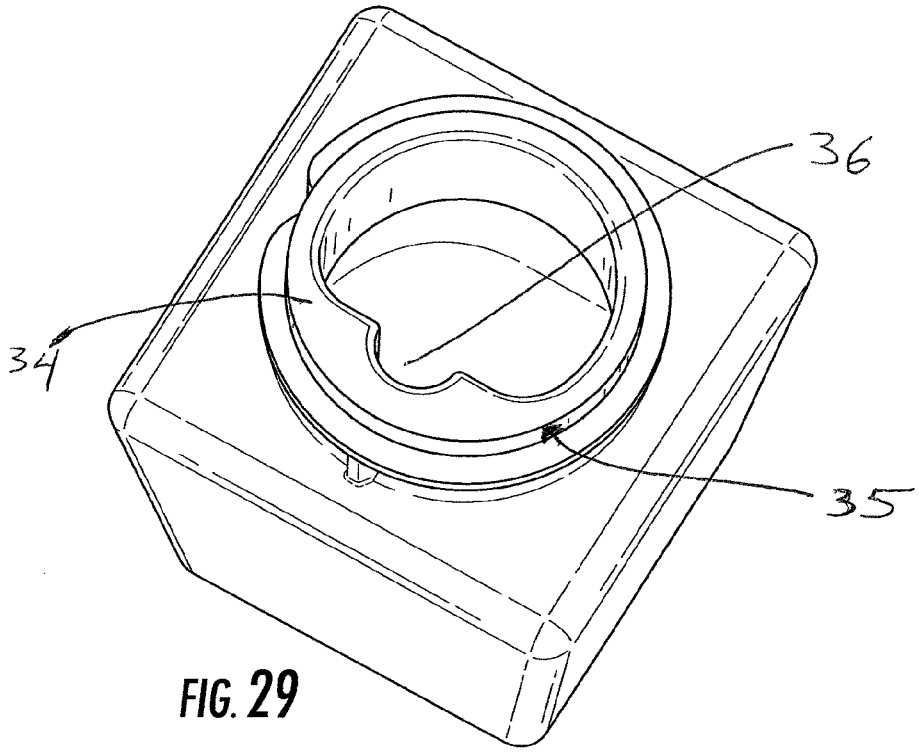
FIGS. 29 and 30 are upper perspective views of the embodiment of FIG. 8, but with member 35 positioned across the opening of the jar.
Figure 30:
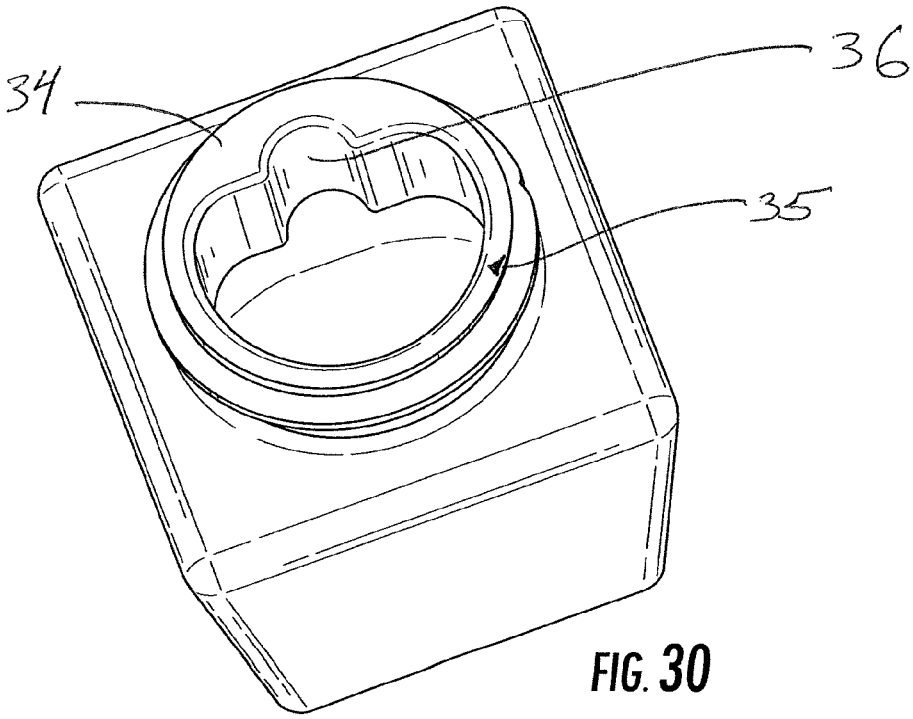

Just as in the first embodiment, the container of the second embodiment can employ a member 35 at the mouth of the jar, as shown in FIGS. 29 and 30.

The invention is not limited by the embodiments described above which are presented as examples only but can be modified in various ways within the scope of protection defined by the appended patent claims. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A container comprising:

a jar defining a volume for containing a liquid material, the jar having a rim with an opening to the jar having a first diameter;

a removable lid having a throughhole of a second diameter, the removable lid having a coupling element, the removable lid configured to seal the opening of the jar and being releasably secured thereat by the coupling element;

a tool configured and operative selectively to extend through the removable lid and to be removably attached thereto, the tool having a handle portion and a working portion, the working portion being disposed in the volume when the tool extends through the jar opening, wherein the working portion has a diameter less than the second diameter; and a member defining a ledge arranged at the rim of the jar and configured to hold the tool, wherein the ledge defines a slot configured to mate with the handle portion of the tool;

wherein the second diameter is smaller than the first diameter, such that for an amount of liquid material above a threshold amount, the tool can be used to access the liquid material through the throughhole, and for an amount of liquid material at or below the threshold amount, the lid can be removed from the jar and the tool can be removed from the lid such that the tool can be used to access the liquid material without the throughhole.

2. The container according to claim 1, wherein the coupling element of the removable lid further comprises a wiping element configured to wipe at least part of the tool.

3. The container according to claim 2, wherein the tool is a brush assembly.

4. The container according to claim 1, wherein the slot comprises a wiping element configured to wipe at least part of the tool.

5. The container according to claim 1, wherein the removable lid comprises a peripheral lip for position about the rim of the jar.

6. The container according to claim 5, wherein the coupling element overlays a top surface of the removable lid.

7. The container according to claim 1, further comprising a land on a center of the removable lid through which the throughhole extends.

8. The container according to claim 7, wherein the land provides releasable coupling with the tool handle.

9. The container according to claim 8, wherein the land comprises threading to threadingly engage the tool handle.

10. The container according to claim 1, wherein the removable lid is threadingly attached to the jar.

* * * * *